United States Patent [19]

Enosawa

[11] Patent Number: 4,896,461

[45] Date of Patent: Jan. 30, 1990

[54] INTERNAL GRINDING MACHINE

[75] Inventor: Hideki Enosawa, Narashino, Japan

[73] Assignee: Seiko Seiki Kabushiki Kaisha, Chiba, Japan

[21] Appl. No.: 180,214

[22] Filed: Apr. 11, 1988

[30] Foreign Application Priority Data

Apr. 10, 1987 [JP] Japan ..... 62-88094

[51] Int. Cl.[4] ..... B24B 47/22

[52] U.S. Cl. ..... 51/103 WH; 51/215 HM

[58] Field of Search ... 51/103 WH, 103 TF, 215 AR, 51/215 HM, 290

[56] References Cited

U.S. PATENT DOCUMENTS 3,158,970 12/1964 Lockwood ..... 51/103 WH 4,616,448 10/1986 Nagata ..... 51/215 H

*Primary Examiner*—Frederick R. Schmidt

*Assistant Examiner*—Jack W. Lavinder

*Attorney, Agent, or Firm*—Bruce L. Adams; Van. C. Wilks

[57] ABSTRACT

In an internal grinding machine of the type in which a workpiece is supported by three contact points by a fixed shoe and two rolls, the present invention facilitates correct feed and discharge of workpieces one by one without regard to the diameter of a workpiece. This is made possible by furnishing an internal grinding machine with a workpiece guide plate having a V-shape projection at its underside by the side of an upper roll in such a manner that the workpiece guide plate can swing up and down. When a workpiece is fed, the workpiece temporarily pushes up the V-shape projection, then reaches the end of the shoe. And it is pushed downward at the end of the shoe by the end portion of the workpiece guide plate, and is fed into the support space. When a finished workpiece is pushed by the workpiece newly fed in the manner as described above and discharged from the support space, the finished workpiece temporarily pushes up the said V-shape projection and is discharged.

9 Claims, 3 Drawing Sheets

INTERNAL GRINDING MACHINE

BACKGROUND OF THE INVENTION

The present invention relates to an internal grinding machine, particularly to the means for feeding and discharging a workpiece thereof.

A prior art internal grinding machine such as shown in FIG. 7 comprises a lower roll 1 rotatably provided at a frame (not shown), an upper roll 2 provided rotatably at a frame above the lower roll 1 and movable further and closer in relation to the lower roll 1, the control axis of which is set slightly (h) horizontally off (to the left in the figure) the central axis of the lower roll 1, and a shoe 5 provided on a side opposite (on the right in the figure) to the side on which the off-set is provided between the lower roll 1 and the upper roll 2 (on the left in the figure), the end face of which contacts with and supports a workpiece 4 fed in a support space 3 between the upper and lower rolls 2 and 1. A workpiece 4 is supported in the support space 3 enclosed between the upper and lower rolls 2 and 1 and the shoe 5, and the internal surface 4*a* of the workpiece 4 is grounded by a rotating grinder (not shown).

When grinding of a workpiece is completed, an unfinished workpiece 4*b* is fed by a pusher 7 along a shoe 5 into the support space 3. At this moment, the finished workpiece 4 which is pushed by the unfinished workpiece 4*b* forces away an elastic holding-down rod 8 and is discharged outside of the machine (to the direction of the arrow) from the support space 3; and the unfinished workpiece 4*b* is held down by the elastic force of the holding-down rod 8 so that the unfinished workpiece 4*b* is not discharged together with the finished workpiece 4.

However, since a conventional internal grinding machine has a structure in which a workpiece is fed through the use of such workpiece charge means as described hereabove, there are chances that feeding and discharging of a workpiece are not properly carried out. A method of discharging a finished workpiece with the use of an elastic holding-down rod 8 operates well when diameter and width of a workpiece are sufficiently large. But on the other hand when they are very small, the holding-down rod 8 have to be very thin and consequently the adjustment becomes very difficult.

As shown in FIG. 8, it is difficult to keep a constant relation between a contact angle 8 and the length of a rod L. If the contact angle 8 is misadjusted as shown in FIG. 9, an unfinished workpiece sometimes sticks to the end face of the pusher 7 due to oil and returns with the pusher 7 without having been correctly discharged into the support space 3. If the rod length L is misadjusted as shown in FIG. 10, it happens that a finished workpiece is not discharged and trapped together with an unfinished workpiece, which disables correct discharge of workpiece one by one.

SUMMARY OF THE INVENTION

In order to solve the abovementioned problems, the present invention provides an internal grinding machine with the following structure. In an internal grinding machine which comprises a lower roll rotatably provided at a frame, an upper roll provided rotatably at a frame above the lower roll and movable further and closer in relation to the lower roll, the central axis of which is set horizontally off the central axis of the lower roll, a shoe provided on a side opposite to the side on which the off-set is provided between said lower roll and said upper roll, the end face of which contacts with and supports a workpiece fed in a support space between the upper and lower rolls, and a pusher for feeding along the shoe a workpiece into said support space, a workpiece guide plate capable of swinging up and down with its one end being pushed downward is provided at the side of the upper roll, and it has a V-shape projection at the lower side of its end portion, wherein a workpiece temporarily pushes up the V-shape projection when fed by the pusher, then it is pushed downward at the end of the shoe by the end portion of the workpiece guide plate and is fed into the support space; and when a finished workpiece is pushed by the unfinished workpiece fed in this manner and is discharged from the support space, the finished workpiece temporarily pushes up the V-shape projection before it is discharged.

According to the internal grinding machine having such structure as abovementioned, the workpiece guide plate capable of swinging up and down with its one end being pushed downward is provided by the side of the upper roll, and the V-shape projection is provided at the lower side of its end portion. When a workpiece is fed being pushed by the pusher, the workpiece temporarily pushes up the V-shape projection, then it is pushed downward at the end of the shoe and is fed into the support space. Therefore, this structure effectively prevents workpieces from sticking to the pusher due to oil and returning with the pusher without having been discharged into the support space, and workpieces can be fed correctly one by one without regard to their sizes.

When the finished workpiece is pushed by a newly fed unfinished workpiece and discharged from the support space, the finished workpiece temporarily pushes up the V-shape projection and is then discharged. Because of this feature, immediately after the finished workpiece has moved past just under the tip of the V-shape projection, the V-shape projection wedges between the finished workpiece and an unfinished workpiece thereby effectively prevents a finished workpiece from being trapped together with an unfinished workpiece, and therefore workpieces can be correctly discharged one by one without regard to their sizes.

Furthermore, since the action of the contact angle 0 and rod length L in the case of a conventional holding-down rod is defined by the location of the pivot and stopper in the case of workpiece guide plate, the adjustment is easier and the relation therebetween can be kept at constant thereby effecting the abovementioned effects.

DESCRIPTION OF THE DRAWINGS

FIG. 1 is a front view of its main portion,

FIG. 2 is a sectional side elevation of the main portion shown in FIG. 1, FIG. 3 is an enlarged detail around the workpiece 15 shown in FIG. 1, FIG. 4 and FIG. 5 are enlarged detail showing the operation thereof.

FIG. 7 is a front view of its main portion, and

FIG. 8–FIG. 10 are enlarged detail showing the operation thereof.

DETAILED DESCRIPTION OF THE PREFFERED EMBODIMENT

Embodiments of the present invention are hereunder described with reference to drawings. FIG. 1 to FIG. 5 illustrate a first embodiment of an internal grinding machine according to the present invention.

Figure 1:
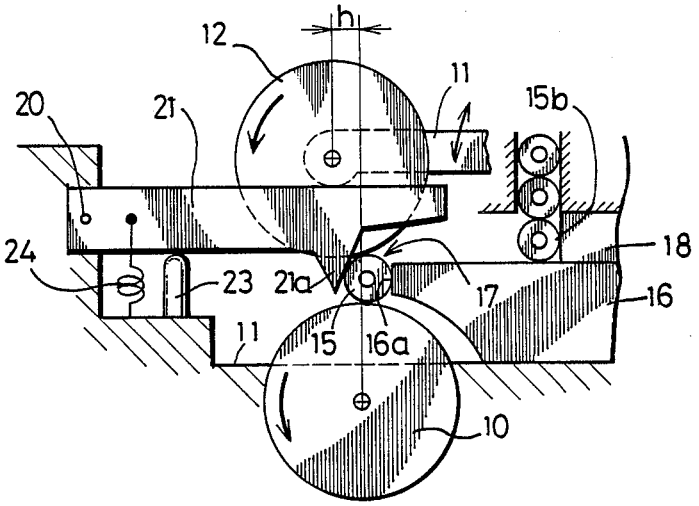
FIG. 1–FIG. 5 illustrate a first embodiment of internal grinding machine according to the present invention.

Firstly, its structure is described. In FIG. 1, a lower roll 10 is rotatably provided at a frame 11 of the internal grinding machine. Above the lower roll 10, an upper roll 12 is rotatably provided at a frame 11*b* in such a manner that it is movable closer and further in relation with the lower roll 10. The upper roll 12 is disposed with its central axis being shifted a little (h) to the left horizontally from the central axis of the lower roll 10.

Between the upper roll 12 and lower roll 10, and on a side horizontally opposite to the side on which the off-set is provided between the lower roll 10 and the upper roll 12 (on the left in the figure), a shoe 16 is fixed to the frame 11 wherein the end face of the shoe 16*a* contacts with and supports a workpiece 15 fed into a support space 17 between the upper roll 12 and lower roll 10.

On the shoe 16, a pusher 18 is slidably provided in horizontal direction in the figure. The pusher 18 feeds an unfinished workpiece 15*b* along the shoe 16 into the support space 17.

Figure 2:
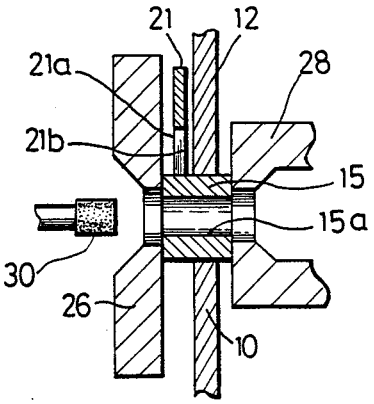

As illustrated in FIG. 2, by the side of the upper roll 12, which is in the front side of the roll in FIG. 1, a workpiece guide plate 21 movable up and down around a pin 20 (the pivot of swing motion) is provided. A V-shape projection 21*a* is formed at the lower side of the end portion of the workpiece guide plate 21. Between the V-shape projection 21*a* and the pin 20, the workpiece guide plate 21 contacts with a stopper 23 at its lower side. Further, a tension spring 24 is provided between the stopper 23 and the pin 20.

As shown in FIG. 2, a workpiece 15, the outer circumferential surface of which is supported between the upper roll 12 and lower roll 11, is supported at its both end surfaces by a front plate 26 and a pressure rotor 28. On the front plate side of the workpiece 15, a grinder 30 which is horizontally movable is provided for grinding the internal surface 15*a* of the workpiece 15.

Figure 3:
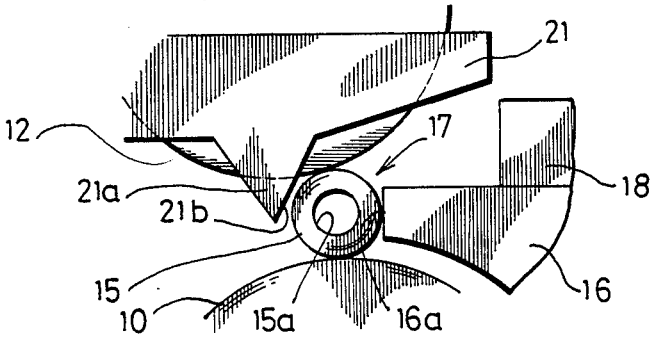

The operation is hereinafter described. As shown in FIG. 3, the workpiece 15 is supported within the support space 17 enclosed by the upper and lower rolls 12 and 10 and the end face 16*a* of the shoe 16 with three contact points on its outer circumferential surface, and its internal surface 15*a* is ground by the rotating grinder 30. During this process, the stopper 23 contacts with the workpiece guide plate 21 and restricts its motion so that the inclined plane 21*b* on the workpiece side of the V-shape projection of workpiece guide plate 21 is spaced apart a little from the workpiece 15.

Figure 4:
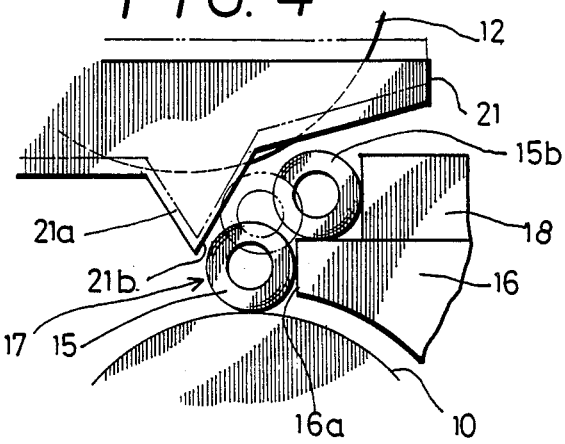

As shown in FIG. 4, as the upper roll 12 moves upward and leaves the workpiece 15, the pusher 18 slides horizontally as shown in figure to the left and feeds an unfinished workpiece 15*b* along the shoe 16 into the support space 17.

The unfinished workpiece 15*b* being pushed by the pusher 18 moves along the shoe 16, then contacts the inclined plane 21*b* of V-shape projection 21*a* of workpiece guide plate 21. The workpiece 15*b* temporarily pushes up the V-shape projection 21*a* (as indicated in a dash and two dotted line), then it is fed into the support space 17. Because of this, when the end face of the pusher 18 has just moved past the end face 16*a* of the shoe 16, the workpiece guide plate 21 moves back to its original position by the force of the tension spring 24, consequently the V-shape projection 21*a* comes down. At this moment, the workpiece 15*b* is pushed by the inclined plane 21*b* of the V-shape projection on workpiece side toward the support space 17, and is separated from the end face of the pusher 18. This feature effectively prevents the workpiece 15*b* from sticking to the end face of the pusher 18 due to oil and returning with the pusher without having been discharged. Therefore workpieces 15*b* can be fed correctly one by one into the support space 17 without regard to their sizes.

Figure 5:
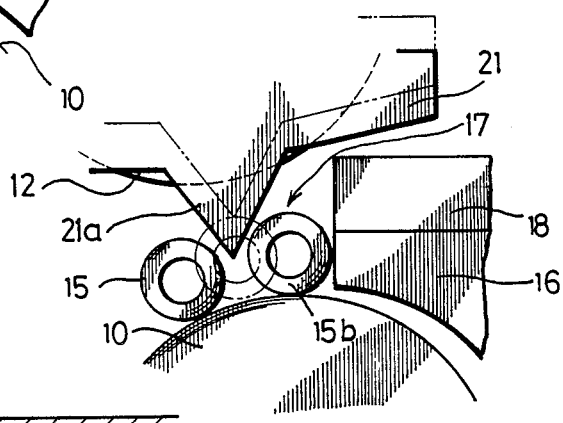

As shown in FIG. 5, when the finished workpiece 15 is pushed by a newly fed unfinished workpiece 15*b* and discharged from the support space 17, the finished workpiece 15 temporarily pushes up the V-shape projection 21*a* (as indicated in a dash and two dotted line) and is then discharged. Because of this feature, immediately after the finished workpiece 15 has just moved past under the tip of the V-shape projection 21*a*, the workpiece guide plate 21 returns down to the original position by the force of the tension spring 24, and the V-shape projection 21*a* wedges between the finished workpiece 15 and an unfinished workpiece 15*b* (as indicated in solid line) thereby effectively prevents the finished workpiece 15 from being trapped together with the unfinished workpiece 15*b* without having been discharged. Therefore, workpieces 15 can be correctly discharged one by one without regard to their sizes.

In the foregoing, feeding and discharging operations were separately described for the sake of convenience. However, these operations occur concurrently.

Figure 6:
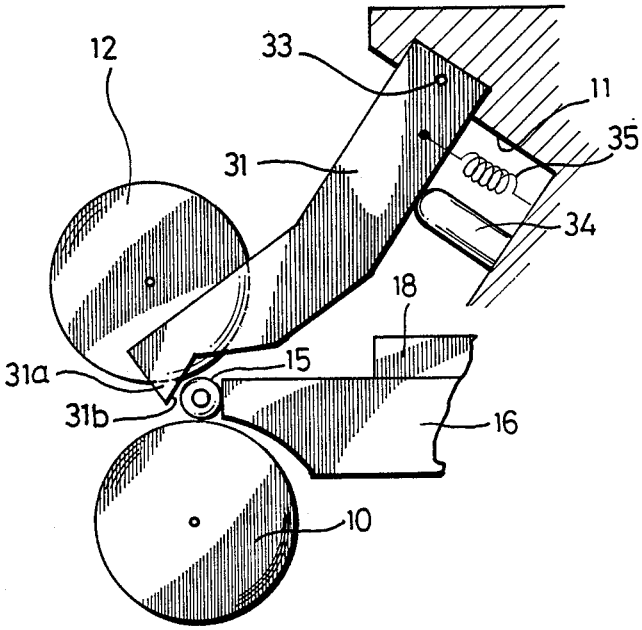
FIG. 6 is a front view of the main portion of a second embodiment of internal grinding machine according to the present invention.
Figure 7:
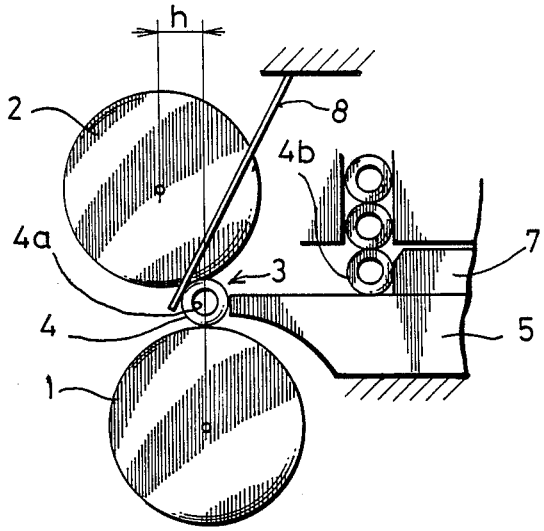
FIG. 7 PRIOR ART
FIG. 7–FIG. 10 shows a conventional internal grinding machine.
Figure 8:
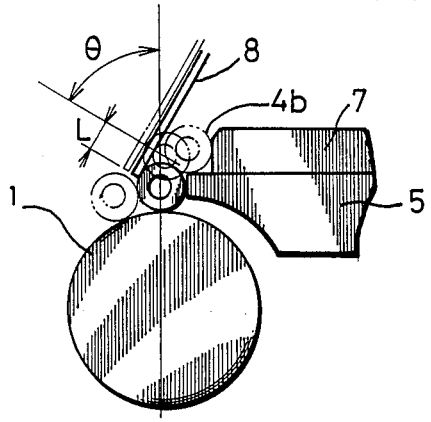
FIG. 8 PRIOR ART
Figure 9:
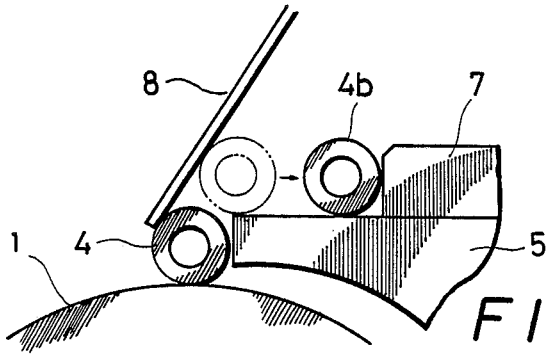
FIG. 9 PRIOR ART
Figure 10:
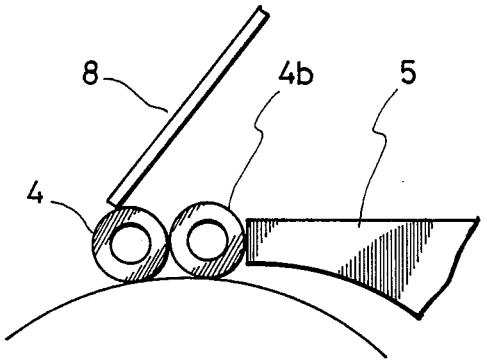
FIG. 10 PRIOR ART

A second embodiment of the present invention is shown in FIG. 6. In the case of the first embodiment, the pivot (pin 20) of the workpiece guide plate 21 is disposed on the opposite side of the shoe 16 and on the extended line of the locus of the shift of pusher 18. On the other hand, the difference in the case of the second embodiment is that the pivot (pin 33) of the workpiece guide plate 31 is disposed on the same side of the shoe 16 and at a place far from the locus of the shift of pusher 18.

In the case of the first embodiment, since an unfinished workpiece 15*b* is pushed by the pusher 18, the V-shape projection 21*a* of the workpiece guide plate 21 is subjected to a thrusting force directed toward the pivot of the workpiece guide plate. This results in a large friction on the inclined plane 21*b* on workpiece side of the V-shape projection 21*a* due to a large frictional force. On the other hand, in the case of the second embodiment, since the pivot (pin 33) of the workpiece guide plate 31 is provided on the same side of the shoe 16 and at a place far apart from the locus of the shift of pusher 18, an unfinished workpiece 15*b* applies a force to the workpiece guide plate 31 in the direction of which the V-shape projection 31*a* moves away from the pivot 33. Therefore, in comparison with the first embodiment, the movement of the workpiece guide plate 31 requires a smaller force, the inclined plane 31*b* on workpiece side of the V-shape projection 31*a* is subjected to a smaller frictional force, and the friction can be made smaller.

Now returning to the figure, numeral 34 is a stopper for restricting the movement of the workpiece guide plate 31, and numeral 35 is a tension spring for pulling back the workpiece guide plate 31 to its original position.

According to the present invention as described in the foregoing, workpieces can be correctly fed and discharged one piece by one piece without regard to their sizes.

Further, according to the second embodiment, since the V-shape projection 31*a* of the workpiece guide plate 31 can be moved with a smaller force compared with the first embodiment, the friction working on the inclined plane 31*b* of the V-shape projection 31 can be reduced compared with the first embodiment.

What is claimed is:

1. An internal grinding machine comprising:

a fixed lower roll rotatably mounted on a frame;

an upper roll rotatably mounted on said frame above said lower roll, said upper roll being movable toward and away from said lower roll;

a shoe provided between said lower roll and said upper roll, said shoe having an end face which contacts and supports a workpiece in a support space between said upper and lower rolls;

means for feeding said workpiece toward said support space; and means for guiding said workpiece into and out of said support space, said guiding means being pivotally mounted at one end and having a contoured projection of substantially V-shape biased toward said workpiece, said projection having at least a pair of cam surfaces, one of which guides said workpiece into said support space before grinding and another of which separates said workpiece from said support space after grinding.

2. An internal grinding machine according to claim 1, wherein said guiding means comprises a rigid plate.

3. An internal grinding machine according to claim 1, further comprising an elastic member biasing said projection toward said workpiece, and a stop member restricting pivotal movement thereof whereby said guiding means is out of contact with said workpiece during grinding.

4. The grinding machine of claim 3, in which said one cam surface engages said workpiece when said workpiece is fed toward said support space, whereby said guiding means is displaced against said elastic member.

5. The grinding machine of claim 1, in which the pivot axis of said guiding means is on the egress side of said support space.

6. The grinding machine of claim 1, in which the pivot axis of said guiding means is on the ingress side of said support space.

7. The grinding machine of claim 1, in which said feeding means comprises a pusher member for advancing a workpiece in one direction along a surface of said shoe.

8. A grinding machine of claim 7, in which said one cam surface and said end face of said shoe provide straddled contact with said workpiece as said workpiece is fed toward said support space, thereby to restrain said workpiece from movement opposite to said one direction.

9. The grinding machine of claim 1, in which said projection defines substantially an acute angle at the apex of said V-shaped cross section.

* * * * *